US006161336A

United States Patent [19]

Ziv-Av

[11] Patent Number: 6,161,336

[45] Date of Patent: Dec. 19, 2000

[54] HINGED AND SLIDING DOOR ASSEMBLY FOR VEHICLES

[76] Inventor: Amir Ziv-Av, 3 Hanasi, Kiryat Ono, Israel

[21] Appl. No.: 09/329,199

[22] Filed: Jun. 10, 1999

[51] Int. Cl.[7] ..... F05D 15/58

[52] U.S. Cl. ..... 49/260; 49/362

[58] Field of Search ..... 49/254, 257, 258, 49/259, 260, 362, 360, 158, 159

[56] References Cited

U.S. PATENT DOCUMENTS

| | | | |
|---|---|---|---|
| 726,362 | 4/1903 | Shrivell | 49/260 |
| 1,341,366 | 5/1920 | Fournier | 49/260 |
| 1,472,457 | 10/1923 | Brown | 49/257 |
| 1,600,796 | 9/1926 | Campbell | 49/260 |
| 1,910,344 | 5/1933 | Kotler | 49/260 |
| 2,710,751 | 6/1955 | Dubiel | 49/260 |
| 4,641,896 | 2/1987 | Iimura et al. | 49/257 |
| 5,636,476 | 6/1997 | Eikmeier et al. | 49/260 |
| 5,687,506 | 11/1997 | Davies et al. | 49/260 |

*Primary Examiner*—Jerry Redman
*Assistant Examiner*—Curtis A. Cohen
*Attorney, Agent, or Firm*—Mark M. Friedman

[57] ABSTRACT

A hinged and sliding door assembly for vehicles includes a door surround defining an opening, a door configured for mating with the door surround, and a hinge-and-slide mechanism for supporting, and defining movement of, the door relative to the surround. The hinge-and-slide mechanism has an intermediate element connected to the door by a hinge structure which defines an axis of rotation about which the door rotates relative to the intermediate element. A slide mechanism, associated with the intermediate element and the surround, is configured to define a slide path of the intermediate element relative to the surround. The slide mechanism is further configured to support the intermediate element such that this axis maintains a substantially constant orientation relative to the surround, thereby supporting the door.

12 Claims, 10 Drawing Sheets

HINGED AND SLIDING DOOR ASSEMBLY FOR VEHICLES

FIELD AND BACKGROUND OF THE INVENTION

The present invention relates to door assemblies for vehicles and, in particular, it concerns a vehicle door assembly which provides both hinged and sliding functions.

Known vehicle door assemblies may be broadly classified according to their opening movement into "hinged doors" and "sliding doors". Hinged doors open by rotation of the entire door about the axis of a hinge attached to the vehicle body, while sliding doors move in a sideways sliding action, typically parallel to the vehicle exterior, to a position displaced from the door surround.

Each of these door assembly types has its own particular advantages and disadvantages. Hinged doors are simple to implement, and are convenient for the user to open and close. As a result, hinged doors have generally been preferred for cars and vans intended primarily for carrying passengers. Nevertheless, hinged doors are far from ideal. Firstly, they require an open space next to the vehicle for opening, becoming difficult to use when insufficient space is available. This has ecological ramifications, requiring wasteful spacing between vehicles for parking. Furthermore, the greater the size of the door opening required, the more space is required to allow the door to swing to its open positions. Finally, even when fully opened, the outwardly projecting door limits access to the opening for loading and unloading the vehicle.

Sliding doors, on the other hand, avoid problems of wasted space and provide maximal access to the opening for loading and unloading. Implementation of sliding doors in vehicles, however, is somewhat complicated. Specifically, aerodynamic and aesthetic considerations generally require that the door, when closed, present a surface substantially continuous with the outer surface of the vehicle. At the same time, for the door to slide, it must stand clear of the door surround. These conflicting considerations are reconciled by various complicated swing-and-slide mechanisms in which the rear edge of the door performs an initial arcuate motion at the beginning of the sliding motion. Examples of such mechanisms may be found in U.S. Pat. Nos. 4,068,407 to Podolan et al. and 4,110,934 to Zens.

Swing-and-slide mechanisms such as those mentioned require complicated lock mechanisms to lock both types of movement, resulting in relatively high costs. Additionally, closing of the door is typically effected by "slamming" the door with sufficient momentum to carry the door through the arcuate motion into a locked state, resulting in a potential safety hazard to fingers. Finally, sliding door assemblies typically require a track located along an adjacent part of the outside of the vehicle. The presence of this track is aesthetically undesirable and limits the positioning of sliding doors to parts of a vehicle which have sufficient flat surfaces adjacent to the door opening.

In the field of doors for buildings, it has been known for many years to provide sliding doors which can also be opened in a hinged motion. An example of such a door assembly can be found in U.S. Pat. No. 2,565,383 to Linchaugh. Such door assemblies have not, however, been used in vehicles, nor would they appear suitable for vehicular applications.

There is therefore a need for a sliding door assembly for vehicles which would combine the advantages of hinged and sliding doors. It would also be highly advantageous to provide a vehicle door assembly which can be opened in either a hinged or a sliding movement as required.

SUMMARY OF THE INVENTION

The present invention is a hinged and sliding door assembly for a vehicle.

According to the teachings of the present invention there is provided, a hinged and sliding door assembly for a vehicle comprising (a) a door surround defining an opening; (b) a door configured for mating with the door surround; and (c) a hinge-and-slide mechanism for supporting, and defining movement of, the door relative to the surround, the hinge-and-slide mechanism including: (i) at least one intermediate element, (ii) a hinge structure connecting between the at least one intermediate element and the door, the hinge structure defining an axis of rotation about which the door rotates relative to the at least one intermediate element, and (iii) a slide mechanism associated with the at least one intermediate element and the surround, the slide mechanism being configured to define a slide path of the at least one intermediate element relative to the surround, the slide mechanism being further configured to support the at least one intermediate element such that the axis of the hinge structure maintains a substantially constant orientation relative to the surround, thereby supporting the door, wherein the door, the surround and the hinge-and-slide mechanism are configured such that the door assumes a closed position in which abutment of the door to the surround prevents sliding of the at least one intermediate element relative to the surround, and a clearance position, rotated about the axis relative to the closed positions, in which at least a part of the door clears the surround in a manner to allow sliding of the at least one intermediate element, and hence of the door, to an open position substantially displaced from the opening.

According to a further feature of the present invention, the hinge structure is further configured such that the door can be rotated about the axis from the closed position through an angle of at least about 45°, through the clearance position to a swung-open position.

According to a further feature of the present invention, the hinge-and-slide mechanism further includes a slide lock mechanism configured to lock the slide mechanism when the door is rotated beyond the clearance position.

According to a further feature of the present invention, the hinge-and-slide mechanism further includes a slide inhibiting element configured to inhibit sliding of the slide mechanism from an initial slide mechanism position.

According to a further feature of the present invention, the hinge-and-slide mechanism further includes a hinge locking mechanism configured to lock the hinge structure against rotation beyond the clearance position when the slide mechanism is displaced from an initial slide mechanism position.

According to a further feature of the present invention, the hinge-and-slide mechanism further includes a hinge biasing mechanism configured to provide resistance against rotation beyond the clearance position.

According to a further feature of the present invention, there is also provided a first latch mechanism associated with the door and the surround, the first latch mechanism being configured to releasably retain the door in the closed position against rotation about the axis.

According to a further feature of the present invention, there is also provided a second latch mechanism associated with the slide mechanism, the second latch mechanism being configured to releasably retain the slide mechanism in an initial slide mechanism position.

According to a feature of the present invention, the slide mechanism includes a linear bearing structure to prevent rotation of the at least one intermediate element relative to the surround.

According to a further feature of the present invention, the slide mechanism includes a tilt preventing mechanism including: (a) an upper toothed track associated with an upper edge of the surround; (b) a lower toothed track associated with a lower edge of the surround; and (c) a gear wheel assembly associated with the at least one intermediate element, the gear wheel assembly including: (i) an upper gear wheel engaged with the upper toothed track; and (ii) a lower gear wheel engaged with the lower toothed track, the lower gear wheel being mechanically coupled so as to rotate with the upper gear wheel.

According to a further feature of the present invention, the at least one intermediate element includes a rigid rod interconnecting between the upper and lower gear wheels.

According to a further feature of the present invention, the gear wheel assembly includes a flexible drive shaft mechanically linked to the upper and lower gear wheels so as to couple them for rotation.

According to a further feature of the present invention, the gear wheel assembly includes a jointed mechanical linkage mechanically linked to the upper and lower gear wheels so as to couple them for rotation.

According to a further feature of the present invention, the surround has an upper edge, a lower edge, a left side and a right side, and wherein the at least one intermediate element extends substantially from the upper edge to the lower edge, the slide mechanism including: (a) a linear bearing track associated with the at least one intermediate element and at least one of the upper edge and the lower edge of the surround; and (b) a tilt preventing mechanism including: (i) a plurality of guide elements associated with the at least one intermediate element and configured to define first and second cable courses running from substantially adjacent to the upper edge to substantially adjacent to the lower edge, (ii) a first cable extending from adjacent to the left side of the upper edge across a first portion of the upper edge, down the first cable course to adjacent to the lower edge, and across a second portion of the lower edge to adjacent to the right side of the lower edge, and (iii) a second cable extending from adjacent to the right side of the upper edge across a second portion of the upper edge, down the second cable course to adjacent to the lower edge, and across a first portion of the lower edge to adjacent to the left side of the lower edge.

According to a further feature of the present invention, the surround has an upper edge, a lower edge, a left side and a right side, and wherein the at least one intermediate element extends substantially from the upper edge to the lower edge, the slide mechanism including: (a) a linear bearing track associated with the at least one intermediate element and at least one of the upper edge and the lower edge of the surround; and (b) a tilt preventing mechanism including: (i) a first closed belt attached to an upper portion of the at least one intermediate element and extending across the surround adjacent to the upper edge from adjacent to the left side to adjacent to the right side, (ii) a second closed belt attached to a lower portion of the at least one intermediate element and extending across the surround adjacent to the lower edge from adjacent to the left side to adjacent to the right side, and (iii) a mechanical belt linkage associated with both the first and the second belts and configured to maintain movements of the first and the second belts in-step.

According to a further feature of the present invention, the surround has an upper edge, a lower edge, a first side and a second side, and wherein the at least one intermediate element extends substantially from the upper edge to the lower edge, the slide mechanism including: (a) a linear bearing track associated with the at least one intermediate element and at least one of the upper edge and the lower edge of the surround; and (b) a tilt preventing mechanism including: (i) a plurality of guide elements defining a cable course extending around the surround from the first side across the upper edge to adjacent to the second side, back across the upper edge to the first side, down to adjacent to the lower edge, across the lower edge from the first side to adjacent to the second side and back to the first side, and back to the upper edge, and (ii) a closed cable deployed along the cable course, wherein the at least one intermediate element is attached to the closed cable at a first attachment position adjacent to the upper edge and a second attachment position adjacent to the lower edge such that the first and second attachment positions move across the upper and lower edges in-step.

There is also provided according to the teachings of the present invention, a hinged and sliding door assembly for a vehicle comprising: (a) a door surround defining an opening; (b) a door configured for mating with the door surround; and (c) a hinge-and-slide mechanism for supporting, and defining movement of, the door relative to the door surround, the hinge-and-slide mechanism including: (i) a hinge structure connected to the door surround, (ii) a slide mechanism associated with the door surround and configured to define a slide path relative to the door surround, and (iii) a mode-switching mechanism associated with the door and with both the hinge structure and the slide mechanism, the mode-switching mechanism including at least one displaceable engagement member, the mode-switching mechanism being deployable between a first state in which the mode-switching mechanism defines a hinged engagement between the door and the hinge structure to allow swung opening of the door and a second state in which the mode-switching mechanism releases the hinged engagement and supports the door by attachment to the slide mechanism such that the door is slidable to an open position substantially displaced from the opening.

BRIEF DESCRIPTION OF THE DRAWINGS

The invention is herein described, by way of example only, with reference to the accompanying drawings, wherein:

FIG. 7A–7C are schematic, partial, vertical cross-sectional views of three alternative mechanical linkages for use in the door assembly of FIG. 4;

DESCRIPTION OF THE PREFERRED EMBODIMENTS

Figure 1:
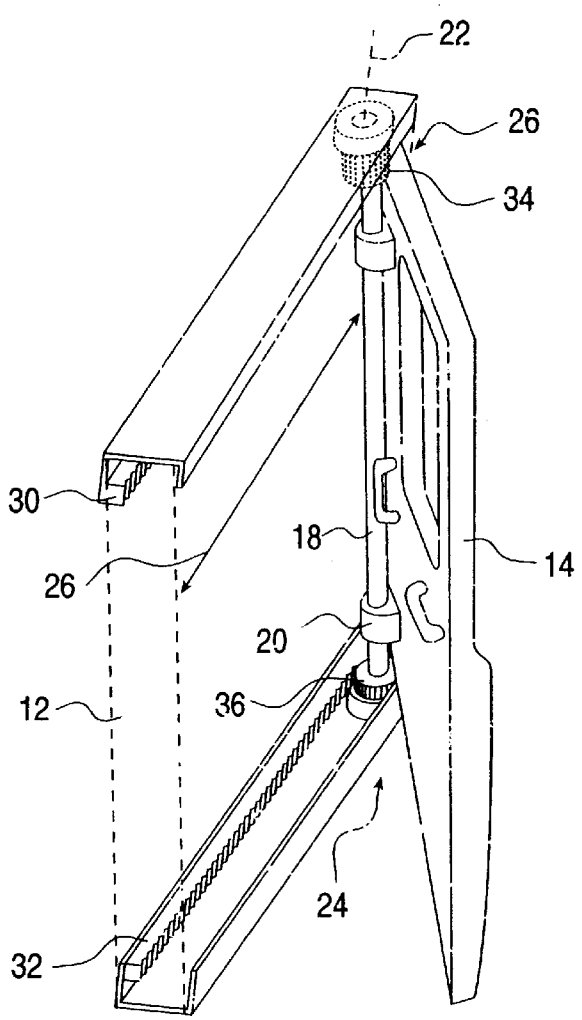
FIG. 1 is a schematic isometric view of a first hinged and sliding door assembly for a vehicle, constructed and operative according to the teachings of the present invention.

The present invention is a hinged and sliding door assembly for a vehicle.

The principles and operation of a hinged and sliding door assembly according to the present invention may be better understood with reference to the drawings and the accompanying description.

Referring now to the drawings, FIGS. 1–7 illustrate a first group of implementations of a hinged and sliding door assembly 10 for a vehicle, constructed and operative according to the teachings of the present invention. A second group of implementations will be described with reference to FIG. 8–11 below.

In general terms, hinged and sliding door assembly 10 includes a door surround 12 defining an opening, a door 14 configured for mating with door surround 12, and a hinge-and-slide mechanism 16 for supporting, and defining has at least one intermediate element 18 connected to door 14 by a hinge structure 20 which defines an axis of rotation 22 about which door 14 rotates relative to intermediate element 18. A slide mechanism 24, associated with intermediate element 18 and surround 12, is configured to define a slide path 26 of intermediate element 18 relative to surround 12. Slide mechanism 24 is further configured to support intermediate element 18 such that axis 22 maintains a substantially constant orientation relative to surround 12, thereby supporting door 14.

Figures 6A, 6B, 6C, 6D:
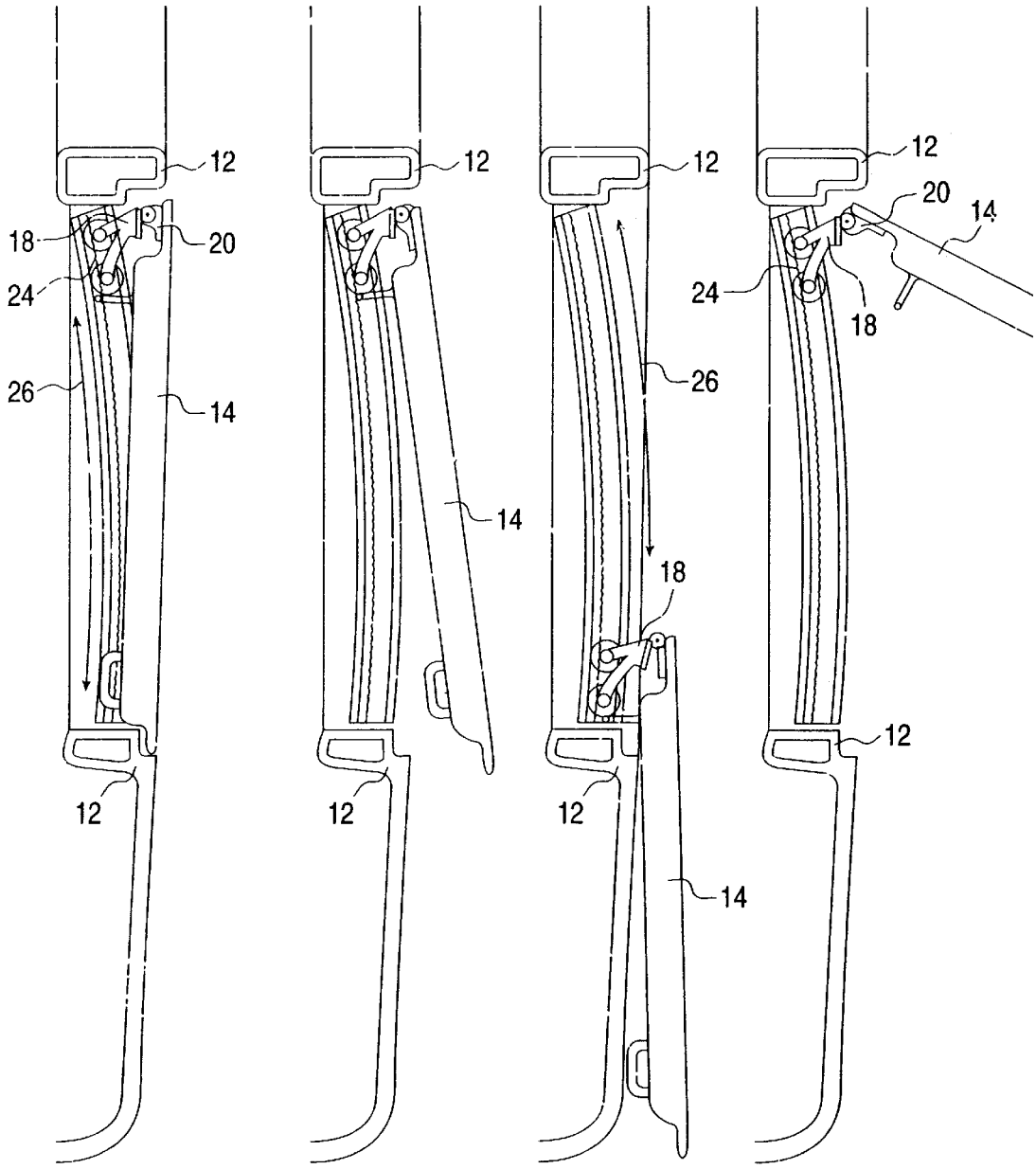
FIG. 6A–6D are horizontal cross-sectional view through the door assembly of FIG. 4 showing it in a closed position, a clearance position, a slid open position and a swung open position, respectively.

As will be best understood with reference to FIGS. 6A–6C, the door assembly is configured such that door 14 assumes a closed position (FIG. 6A) in which abutment of door 14 to surround 12 prevents sliding of intermediate element 18 relative to surround 12, and a clearance position (FIG. 6B), rotated about axis 22 relative to the closed position, in which at least a part of door 14 clears surround 12 in a manner to allow sliding of intermediate element 18, and hence of door 14, to a slid-open position (FIG. 6C) substantially displaced from the opening.

It will be readily appreciated that the present invention offers profound advantages, even when implemented as a replacement for conventional vehicle sliding doors. Specifically, the final closing action is a purely hinged motion identical to the closing motion of a conventional hinged door, rendering it light to operate and avoiding the need for a high-momentum slamming action. At the same time, the door assembly provides all the advantages of full access and space saving offered by conventional sliding doors.

In most preferred embodiments, hinge structure 20 is further configured such that door 14 can be rotated about axis 22 from the closed position through an angle of at least about 45°, and preferably to a maximum angle of between about 60° and about 90°, through the clearance position of FIG. 6B to a swung-open position as shown in FIG. 6D. In this case, door assembly 10 offers a user the full functionality of both a hinged and a sliding door. Optionally, hinge structure 20 may include multiple hinges turning around a common axis or separate axes, and may where required offer ranges of hinged movement up to about 180°or even 270°, as is known in the art.

It will be readily apparent that the door assemblies of the present invention are highly advantageous for use in a wide range of applications. Examples include, but are not limited to, vans and cars. In the case of vans, the present invention avoids the compromise normally required between hinged and sliding doors by providing all the advantages of both. In the case of cars, the invention supplements the conventional hinged door operation with a sliding option to allow space-saving parking formations and improved access when needed.

In order that the initial opening and final closing action be a purely hinged motion, it is a preferred feature of most embodiments of the present invention that door 14 is supported substantially exclusively via hinge structure 20, at least during this hinged movement between the closed position and the clearance position. At the same time, intermediate element 18 to which hinge structure 20 connects is required to be slidable along a slide path defined by slide mechanism 24. This requires intermediate element 18 to be supported by slide mechanism 24 in an upright orientation so as to provide reactive forces sufficient to support the weight of door 14 via the hinge. In a simple implementation, this may be achieved by employing an elongated linear bearing sufficiently rigid to support the weight of the door. In preferred implementations, this is achieved by providing a tilt preventing mechanism, examples of which will be described with reference to the embodiments presented below.

Turning now to the features of the present invention in more detail, FIGS. 1–7 show a first group of embodiments of door assembly 10 in which slide mechanism 24 includes a tilt preventing mechanism having an upper toothed track 30 associated with an upper edge of surround 12 and a lower toothed track 32 associated with a lower edge of the surround 12. A gear wheel assembly associated with intermediate element 18 includes an upper gear wheel 34 engaged with upper toothed track 30 and a lower gear wheel 36 engaged with lower toothed track 32. Lower gear wheel 36 and upper gear wheel 34 are mechanically coupled so as to rotate together, thereby insuring that the upper and lower ends of intermediate element 18 move across the opening in-step.

Figure 2:
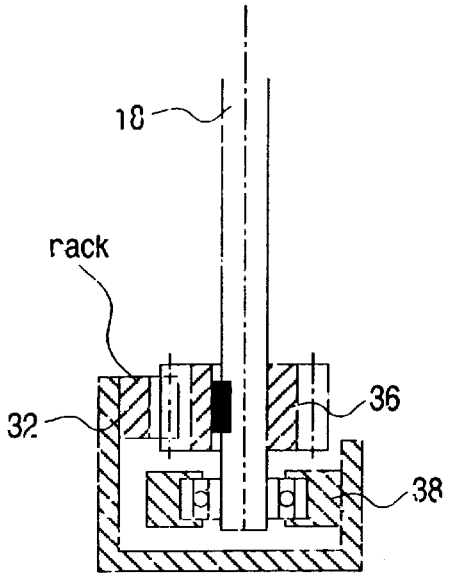
FIG. 2 is a cross-sectional view through a lower track of the door assembly of FIG. 1.

FIGS. 1 and 2 show a particularly simple implementation of door assembly 10 in which intermediate element 18 is implemented as a rigid rod interconnecting between upper and lower gear wheels 34 and 36 such that the entirety of intermediate element 18 and upper and lower gear wheels 34 and 36 rotate together as a unit. FIG. 2 shows one possible implementation for maintaining engagement between one of the gear wheels and the corresponding toothed track, employing a guide wheel 38 located within a U-shaped track.

While providing a particularly simple and elegant solution to the need for right support of intermediate element 18, this implementation is somewhat limited. Specifically, the fact that the entirety of intermediate element 18 itself rotates relative to surround 12 preludes the possibility of spring biasing of hinge structure 20. Nevertheless, this implementation may be an attractive and cost effective possibility, particularly for use with relatively small, lightweight doors such as in cars.

FIGS. 3–6 show a preferred embodiment of the present invention employing a gear-wheel-based tilt preventing mechanism. In this case, intermediate element 18 is implemented as a bracket having at least one additional guide wheel 40 deployed to provide what is effectively a linear bearing, thereby keeping intermediate element 18 in a fixed known alignment with tracks 30 and 32. This facilitates the use of various spring-biasing and/or locking mechanisms associated with the hinged motion of door 14 relative to intermediate element 18, as will be discussed below. This structure of intermediate element 18 also allows flexibility as to the positioning of hinge axis 22 relative to slide mechanism 24, which may facilitate design of door assembly 10 to open in a hinged manner like a conventional hinged door such that door 14 clears the front and back edges of surround 12.

Figure 3:
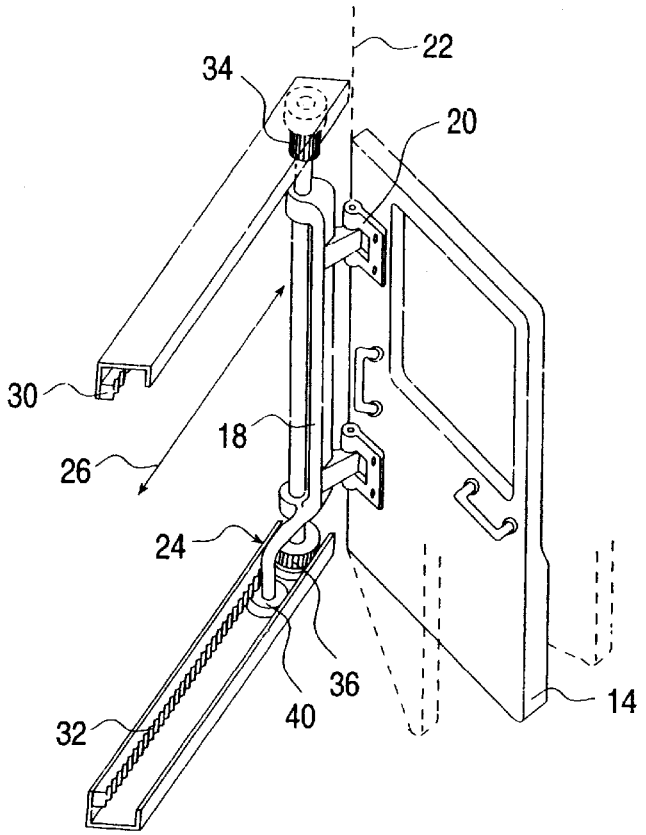
FIG. 3 is a schematic isometric view of a second hinged and sliding door assembly for a vehicle, constructed and operative according to the teachings of the present invention.
Figure 4:
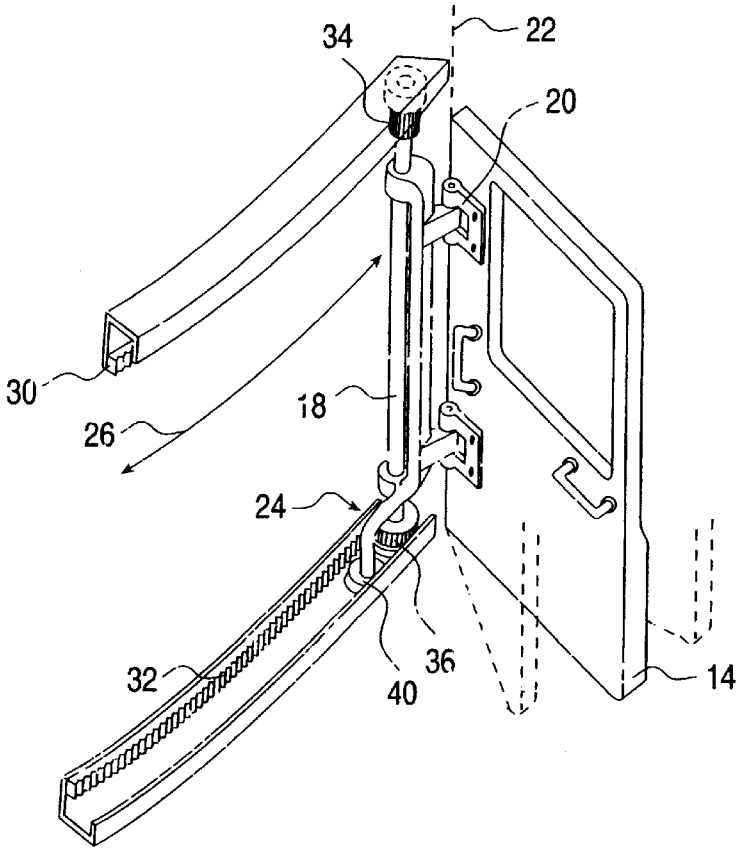
FIG. 4 is a schematic isometric view of a variant of the second door assembly of FIG. 3 employing a curved slide path.
Figure 5:
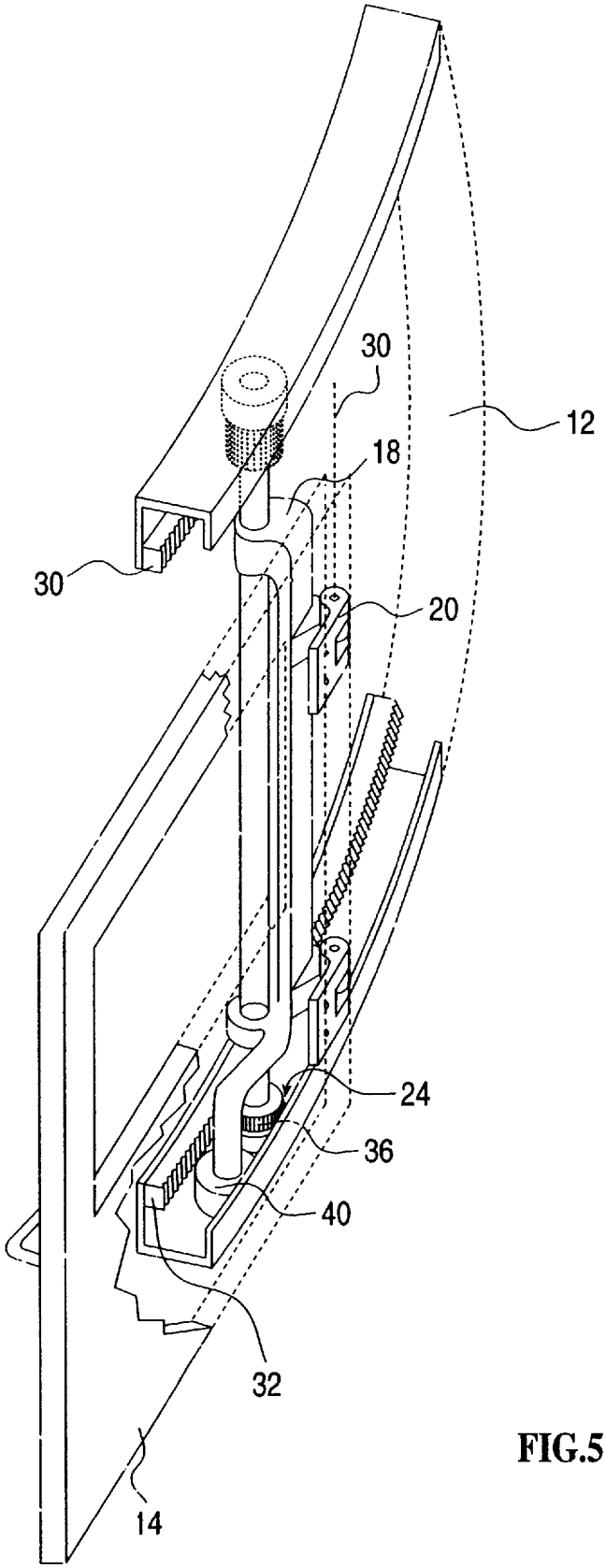
FIG. 5 is a schematic view of the door assembly of FIG. 4 opened in a sliding mode.

It should be appreciated that slide path 26 defined by slide mechanism 24 need not be linear. Thus, while FIG. 3 shows a linear examples, FIGS. 4–6 show a variant in which the slide path is implemented with a slight curvature. The curvature as shown in FIG. 6A–6D is advantageous in certain implementations since it tends to bring door 14 from the clearance position of FIG. 6B to a slid-open position closely adjacent to the outer surface of the vehicle as seen in FIG. 6C without requiring movement of hinge structure 20.

It will be noted that the primary function of the tilt-resisting mechanisms of the present invention is to keep sliding movement of the upper and lower parts of intermediate element 18 along slide path 26 in-step, thereby preventing sagging of door 14. This function is referred to as maintaining axis 22 in a substantially constant orientation during the sliding motion. It should be clearly understood, however, that this terminology does not exclude the possibility of slight variations in the orientation of axis 22 in a manner that does not compromise support of door 14. Thus, by way of example, in a vehicle which has a variable inclination to the vertical along its external surfaces, it may be preferable to make upper toothed track 30 slightly non-parallel to lower toothed track 32 so as to tilt door 14 as it slides to conform more closely to the vehicle's contours.

Reference is also made in the description and claims to "at least one intermediate element 18". This language is to include an implementation in which separate intermediate elements, independently supported directly from the upper and lower parts of slide mechanism 24, are connected to separate portions of door 14 by separate parts of hinge structure 20. Such an implementation would be a functionally equivalent alternative to the single, vertically elongated intermediate element shown here.

It should also be noted that upper and lower toothed tracks 30 and 32 need not be identical, so long as they are effectively engaged by gear wheels 34 and 36, respectively, and as long as the slide mechanism limits movement of intermediate element to maintain its upper and lower parts in-step. Furthermore, the terminology of gear wheels and toothed racks is used here to refer generally to all structures known in the art as equivalents thereto such as, for example, arrangements of sprockets with corresponding tracks or chains.

Figure 7B:
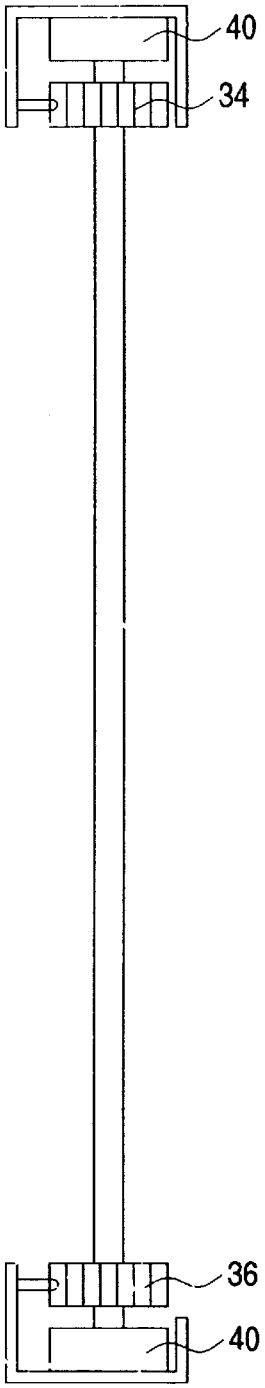
Figure 7B:
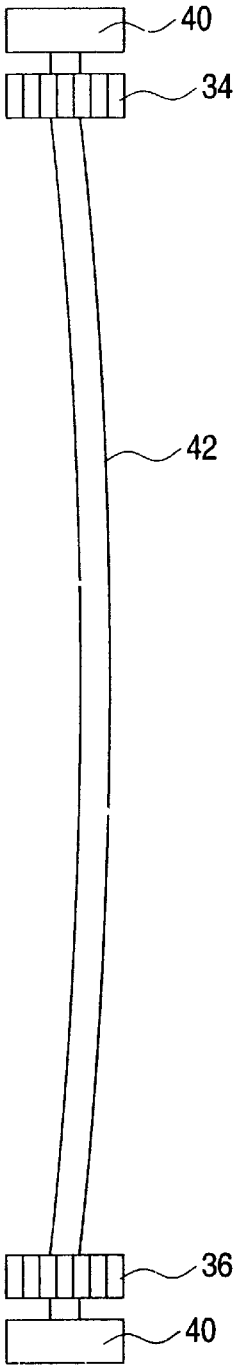
Figure 7C:
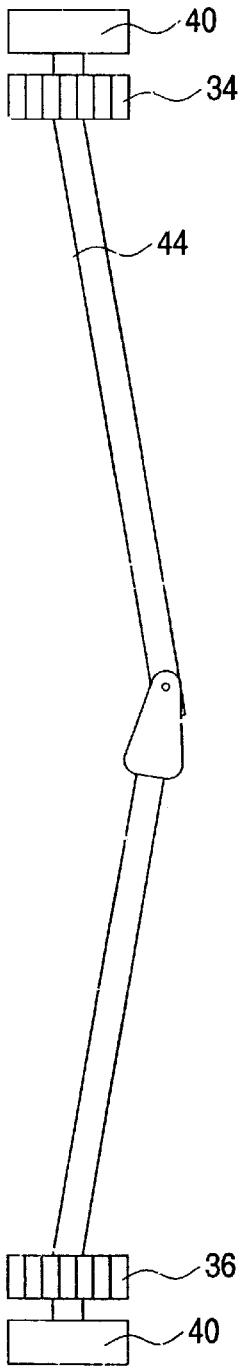

Turning now to FIGS. 7A–7C, it will be noted that, in the structure of FIGS. 3 and 4, intermediate element 18 may be supported directly by its guide wheels from the upper and lower toothed tracks and does not necessarily rely upon mechanical support from the mechanical linkage between gear wheels 34 and 36. As a result, as well as the rigid drive rod option of FIG. 7A (similar to that of FIG. 1), the gear wheel assembly may instead employ a flexible drive shaft 42 mechanically linked to upper and lower gear wheels 34 and 36, as shown in FIG. 7B, so as to couple them for rotation. Alternatively, a jointed mechanical linkage 4, as shown in FIG. 7C, may be used. These latter options are particularly valuable for cases in which the door is to present a concavely curved internal surface, allowing the mechanical link to follow a non-linear path passing within the body of door 14.

As mentioned above, all but the most basic embodiments of the present invention preferably provide various combinations of biasing and/or locking mechanisms to give the user convenient control over the opening mode of the door assembly. Implementation of these features employs combinations of biasing elements and/or latch mechanisms which are well known per se in the art. As a result, for conciseness of presentation, the various preferred options will be described in functional terms only.

Firstly, since the initial opening motion of door assembly 10 is preferably exclusively a pure hinged motion similar to a conventional hinged door, locking of the door assembly is preferably achieved using a latch mechanism, similar to a conventional hinged-door latch mechanism, associated with door 14 and surround 12 on the side furthest from hinge structure 20. The latch mechanism is configured to releasably retain the door in the closed position so as to oppose rotation about axis 22. Additional locking on the hinge side of door 14 (for example, to satisfy accident safety requirements) may be provided by pins and sockets or other complementary projecting and recessed features formed in the door and surround which come into interlocking relation when the door is closed.

Once released from its closed position, the user must be able to clearly identify the clearance position of FIG. 6B. At the same time, for most applications, it is considered preferable that the user be able to open door 14 in a single continuous hinged motion to the swung-open position of FIG. 6D. This combination of properties is advantageously achieved by providing a hinge biasing mechanism, similar to biasing mechanism used for conventional hinged vehicle doors, configured to provide resistance against rotation beyond the clearance position. This provides a readily identifiable clearance position without obstructing intentional hinged opening of door 14 to its full extent.

Optionally, the hinge biasing mechanism may be supplemented by a hinge locking mechanism configured to lock hinge structure 20 against rotation beyond the clearance position when slide mechanism 24 is displaced from its initial slide mechanism position. This serves to prevent flapping open of door 14 away from the vehicle body when a slide-opening mode is in use. Alternatively, the hinge biasing mechanism may be altogether replaced by a normally-locked hinge locking mechanism which restricts rotation of door 14 about axis 22 to the clearance position until actively released.

In a similar manner, sliding of intermediate element 18 is preferably prevented or inhibited by various latch or biasing mechanism during hinged motion of door 14. According to a first option, a second latch mechanism, associated with slide mechanism 24, is configured to releasably retain slide mechanism 24 in an initial slide mechanism position until actively released, In this case, a handle for releasing the slide mechanism latch is preferably located near the side of door 14 adjacent to hinge structure 20 which is most convenient for sliding operation. This ensures that, after initial opening to its clearance position, the mode of operation of the door is selected in a very intuitive manner by choice of the door handle griped by the user. Alternatively, a slide inhibiting element is configured to inhibit sliding of slide mechanism 24 from its initial position. In the latter case, the slide inhibiting mechanism may optionally be supplemented by a slide lock mechanism which locks slide mechanism 24 selectively when door 14 is rotated beyond the clearance position of FIG. 6B.

Figure 10:
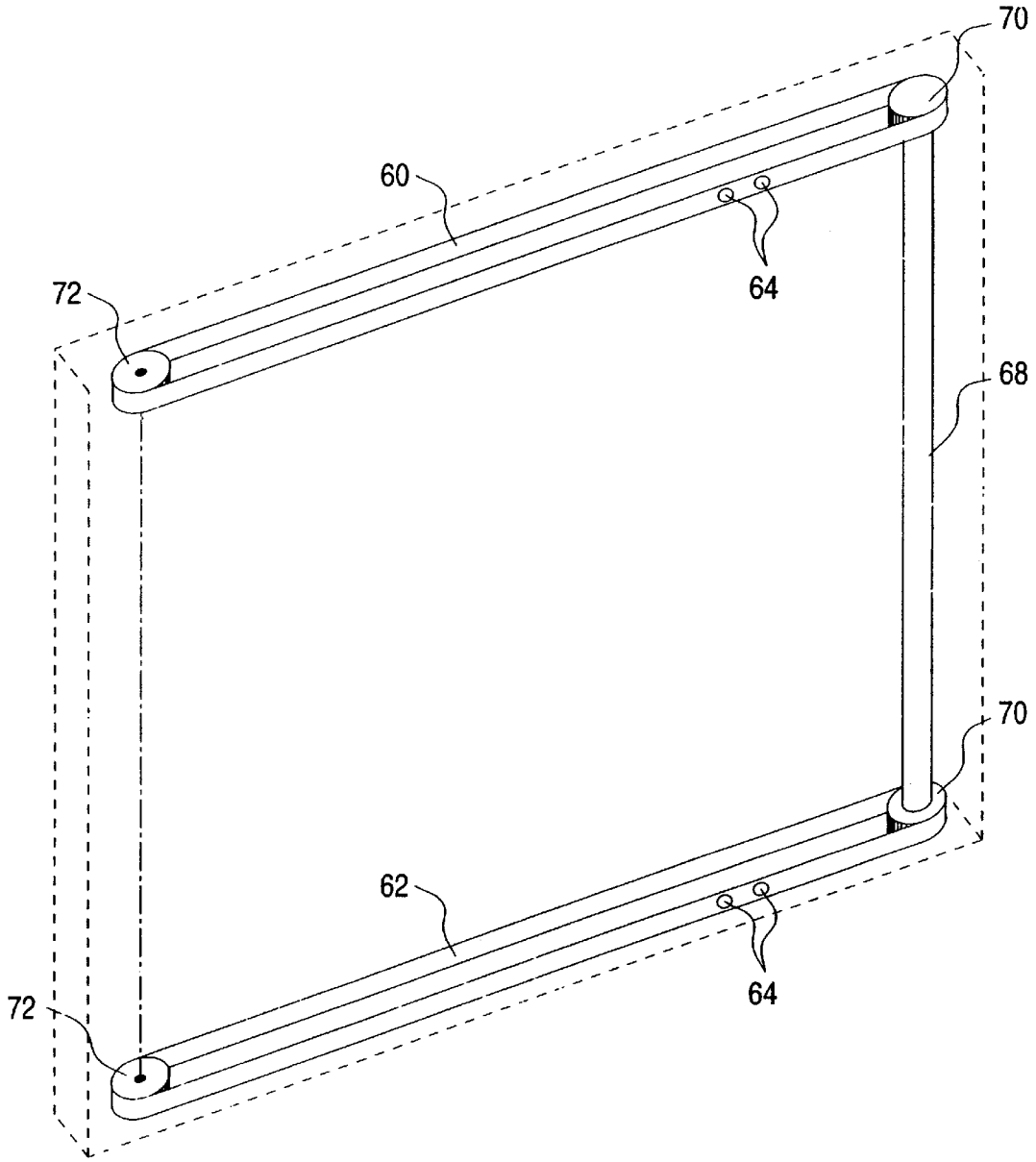
FIG. 10 is a schematic isometric illustration of the operation of an alternative cable-based support mechanism.
Figure 11:
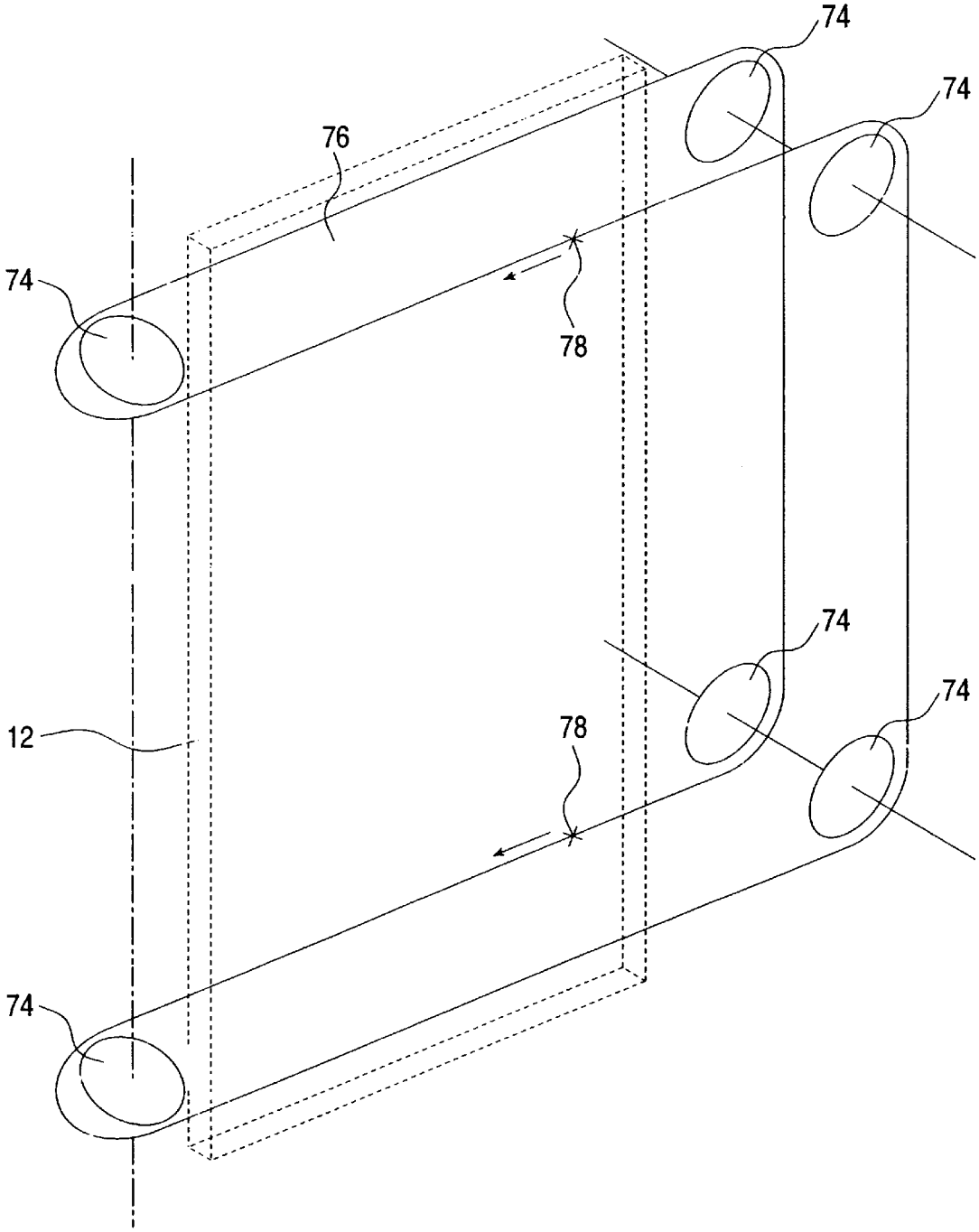
FIG. 11 is a schematic isometric illustration of the operation of a further alternative cable-based support mechanism.

In addition to locking and/or biasing features, it should be appreciated that the door assemblies of the present invention may readily be implemented with other features know in the art. For example, slide mechanism 24 may readily be adapted to provide power-assisted or fully-automatic opening and/or closing motion. The mechanisms to be described below with reference to FIGS. 10 and 11 are particularly suited to such implementations.

Turning now to FIGS. 8–11, reference will now be made to embodiments of door assembly 10 employing cable-based tilt-resisting mechanisms. It should be appreciated that these embodiments are in all other respects similar to the embodiments described above, and may include any of the features mentioned therein.

In general terms, these embodiments also employ a linear bearing track 50, associated with intermediate element 18 and at least one, and preferably both, of the upper and lower edges of surround 12, to define slide path 26. Various arrangements of cables, to be described, are then used to provide a tilt-preventing mechanism to maintain axis 22 in a substantially constant orientation during the sliding motion.

It should be appreciated that the term "cable" is used herein to refer to any flexible cable, belt or chain which is sufficiently strong to transfer the required forces to maintain alignment of intermediate element 18. The cable may be formed with any desired cross-sectional shape including, but not limited to, circular and flat belt forms. Preferably, the cable is substantially non-elastic under the normal working conditions of the systems. Preferred examples include, but are not limited to, wound steel cable and high-tension polymer cables.

Figure 8:
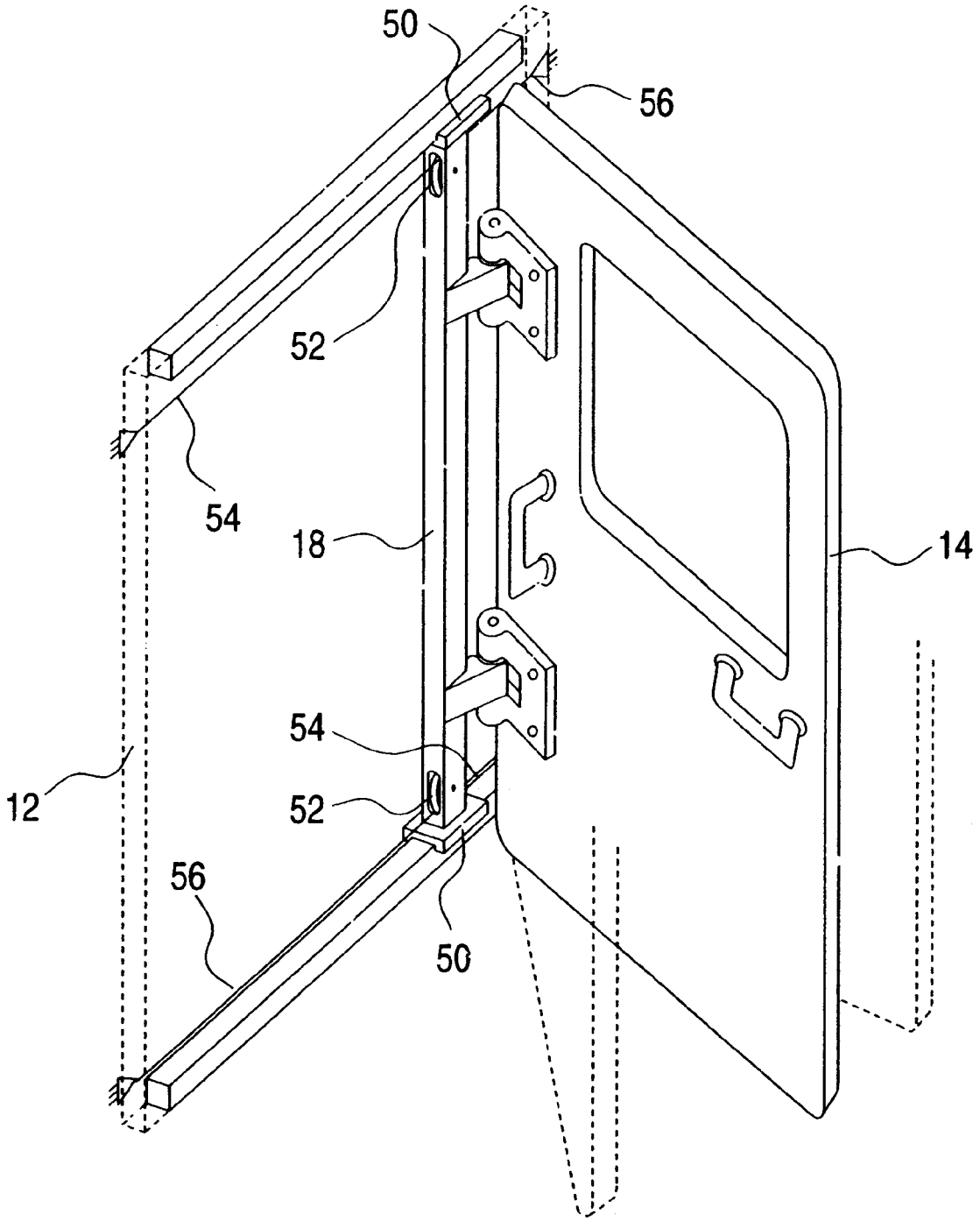
FIG. 8 is a schematic isometric view of a third hinged and sliding door assembly for a vehicle, constructed and operative according to the teachings of the present invention, employing a cable-based support mechanism.
Figure 9:
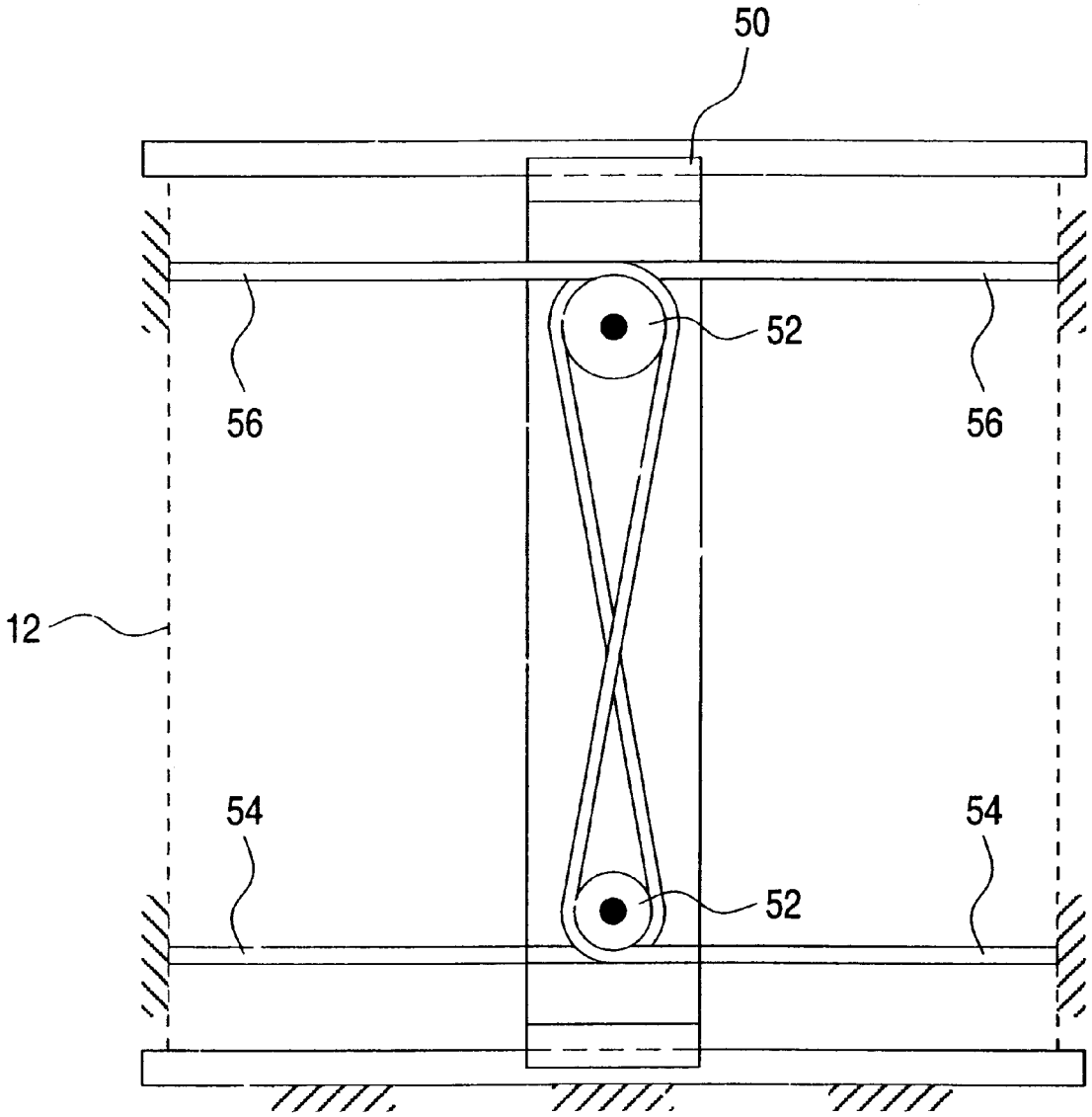
FIG. 9 is a schematic, partially cut-away side view illustrating the operation of the cable-based support mechanism of the door assembly of FIG. 8.

Turning now to FIG. 8 and 9, these show a first cable-based tilt preventing mechanism in which is plurality of guide elements 52 are associated with the at least one intermediate element 18 so as to define first and second cable courses running from substantially adjacent to the upper edge of surround 12 to substantially adjacent to its lower edge. Preferably, guide elements 52 include at least two pulleys, or a single pulley formed with two tracks, rotatably mounted near the upper end of intermediate element 18 and at least two pulleys, or a single pulley formed with two tracks, ratably mounted near its lower end. Optionally, the cable course may follow a curved path, with or without the use of additional pulleys, so as to follow, or pass within, the body of door 14.

The orientation of intermediate element 18 is then insured by a pair of cables deployed as shown in FIG. 9. Specifically, a first cable 54 extends from adjacent to the left side of the upper edge of surround 12 across a first portion of its upper edge, down the first cable course to adjacent to the lower edge of surround 12, and across a second portion of its lower edge to adjacent to the right side of the lower edge. A second cable 56 extends from adjacent to the right side of the upper edge of surround 12 across a second portion of its upper edge, down the second cable course to adjacent to the lower edge of surround 12, and across a first portion of the lower edge to adjacent to the left side of the lower edge. When the ends of the cables are fixed with sufficient tension between them, this structure is highly effective to maintain intermediate element 18 in a predefined orientation, standing substantially perpendicular to slide path 26.

Turning now to FIG. 10, this shows schematically an alternative cable-based tilt-preventing mechanism for use in the door assembly of FIG. 8. In this case, two closed-loop cables, shown here as belts 60 and 62 extend across surround 12 adjacent to the upper and lower edges, respectively, from adjacent to the left side to adjacent to the right side. Each belt features an attachment position 64 configured for attachment to an upper or lower portion, respectively, of intermediate element 18. A mechanical belt linkage 66 is associated with both first and second belts 60 and 62, and configured to maintain movements of the two belts in-step.

Mechanical belt linkage 66 may conveniently be implemented as a rigid, flexible or jointed drive rod 68 with associated upper and lower gear wheels 70, similar to the structures of FIGS. 7A–7C, but deployed at fixed positions near the side of surround 12 so as to engage belts 60 and 62. At the other side of surround 12, belts 60 and 62 are supported by a pulleys 72 which need neither to be connected nor to share a common axis. Optionally, a second mechanical linkage may be provided between belts 60 and 62.

Turning now to FIG. 11, this shows schematically a further alternative cable-based tilt-preventing mechanism for use in the door assembly of FIG. 74, define a cable course extending around surround 12 from a first side across the upper edge to adjacent to the second side, back across the upper edge to the first side, down to adjacent to the lower edge, across the lower edge from the first side adjacent to the second side and back to the first side, and back to the upper edge. A closed cable 76, deployed along the cable course, has attachment positions 78 adjacent to the upper and lower edges for attachment to intermediate element 18. The attachment positions are chosen such that they move across the upper and lower edges in-step, thereby maintaining intermediate element 18 in a substantially constant orientation during the sliding motion.

It will be noted that the term "closed cable" in this context does not necessarily imply a cable inherently formed as an endless loop. Thus, the term should also be understood to include an open cable with its ends connected in any suitable manner.

Figure 12:
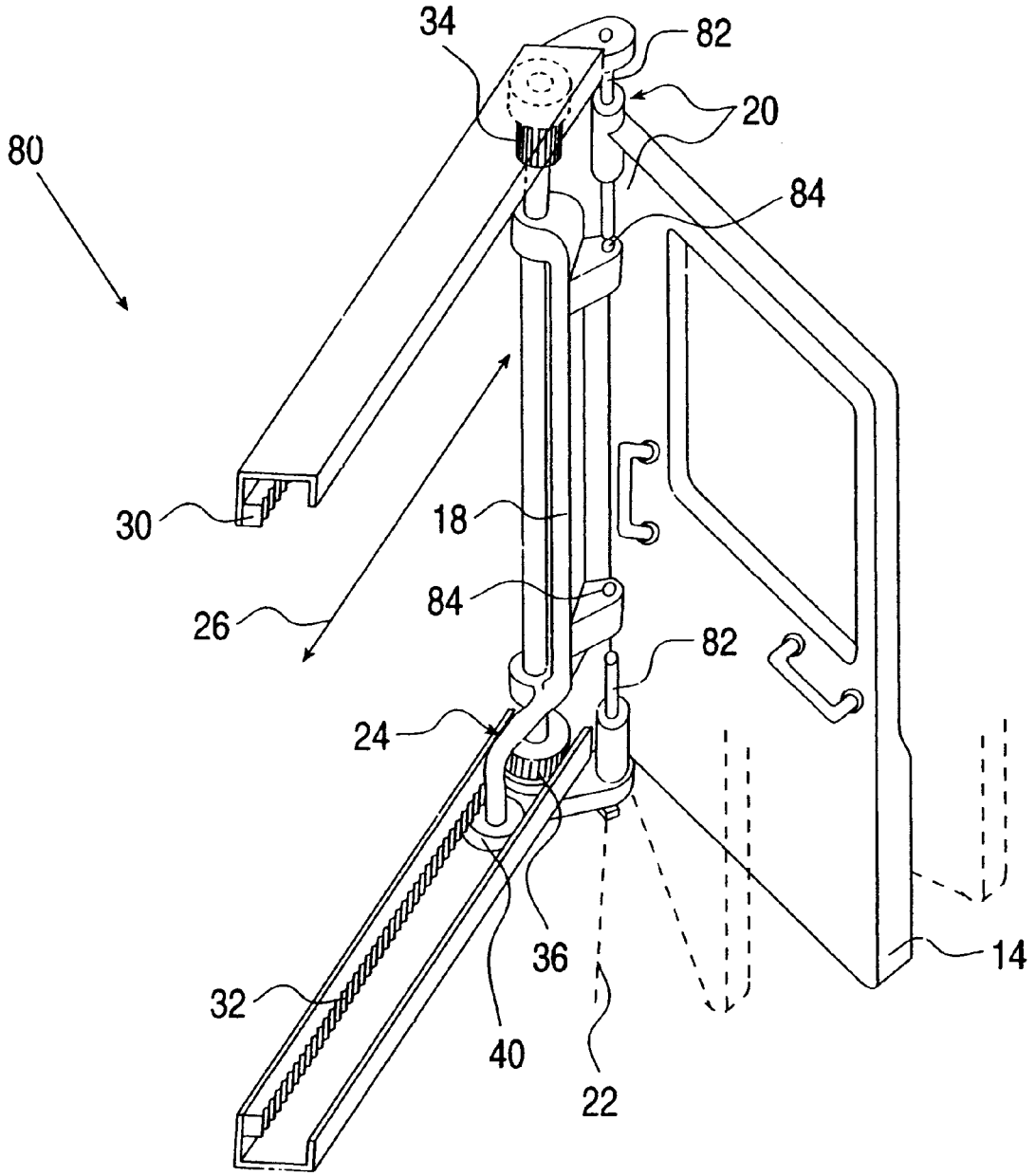
FIG. 12 is a schematic isometric view of a variant of the hinged and sliding door assembly for a vehicle of FIG. 3, constructed and operative according to the teachings of the present invention.

Finally, turning to FIG. 12, there is shown a further embodiment of a hinged and sliding door assembly, generally designated 80, constructed and operative according to the teachings of the present invention, in which hinge structure 20 is mounted directly to surround 12, hinge structure 20 and slide mechanism 24 serving as generally alternative sources of support for door 14. A mode-switching mechanism switches between a hinged state in which door 14 is hingedly mounted via hinge structure 20 in a non-sliding manner to door surround 12, and a sliding state in which door 14 is mounted, preferably in a non-hinged manner, on slide mechanism 24.

In a simple implementation of the mode-switching mechanism, shown here schematically, switching is achieved by withdrawal of hinge bolts 82 slidably engagable in hinge structure 20. On withdrawal, one or more rear portion of each bolt 82 engages one or more corresponding socket 84 formed in a bracket 86 associated with slide mechanism 24. Suitable mechanisms for deploying bolts 82 between their two positions are well within the abilities of one ordinarily skilled in the art, and will not be described here.

In the case that socket 84 lies on axis 22 of hinge structure 20, bolt 82 may optionally remain partially engaged within socket 84 even in the hinged state. In this case the form of bolt 82 and socket 84 is preferably such that further engagement therebetween, and corresponding withdrawal of bolt 82 from hinge structure 20, can only occur when door 14 is in its clearance position. This may be achieved by use of complementary non-circular (e.g. square) cross-sectional forms for parts of bolt 82 and socket 84. This also serves to lock door 14 against hinged motion when switched to the sliding mode.

Alternatively, sockets 84 may be out of alignment with axis 22. In this case, engagement of bolts 82 with sockets 84 can typically only occur at a predetermined angular position of door 14, which is chosen to be the clearance position.

It will be clear that the operation of door assembly 80 is generally similar to that of the door assemblies described above. Specifically, hinge structure 20 defines a hinged mode of operation of the door for opening from the initial closed position to the clearance position, and if desired, further to a swung-open position. When sliding operation is desired, the mode-switching mechanism is actuated while the door is in its clearance position, thereby releasing the door from hinge structure 20 and preparing it for sliding motion supported by slide mechanism 24. Clearly, slide mechanism 24 here may take any of the forms set out above, preferably including a tilt-preventing mechanism of one of the types disclosed above.

It will be appreciated that the above descriptions are intended only to serve as examples, and that may other embodiments are possible within the spirit and the scope of the present invention.

What is claimed is:

1. A hinged and sliding door assembly for a vehicle comprising:

(a) a door surround defining an opening, said door surround having an upper edge and a lower edge;

(b) a door configured for mating with said door surround; and (c) a hinge-and-slide mechanism for supporting, and defining movement of, said door relative to said surround, said hinge-and-slide mechanism including:

(i) an intermediate element substantially spanning between said upper and said lower edges of said surround, (ii) a hinge structure connecting between said intermediate element and said door, said hinge structure defining an axis of rotation about which said door rotates relative to said intermediate element, and (iii) a slide mechanism associated with said intermediate element and with both said upper edge and said lower edge of said surround, said slide mechanism being configured to define a slide path of said intermediate element relative to said surround in such a manner that said intermediate element can slide along said slide path but is prevented from rotating relative to said slide path about an axis parallel to said axis of rotation of said hinge structure, said slide mechanism being further configured to support said intermediate element such that said axis of said hinge structure maintains a substantially constant orientation relative to said surround, thereby supporting said door, wherein said door, said surround and said hinge-and-slide mechanism are configured such that said door assumes a closed position in which abutment of said door to said surround prevents sliding of said intermediate element relative to said surround, and a clearance position, rotated about said axis relative to said closed position, in which at least a part of said door clears said surround in a manner to allow sliding of said intermediate element, and hence of said door, to an open position substantially displaced from said opening.

2. The door assembly of claim 1, wherein said hinge structure is further configured such that said door can be rotated about said axis from said closed position through an angle of at least 45°, through said clearance position to a swung-open position.

3. The door assembly of claim 1, wherein said slide mechanism includes a linear bearing structure associated with each of said upper and said lower edges of said surround to prevent rotation of said intermediate element relative to said surround.

4. The door assembly of claim 1, wherein said slide mechanism includes a linear bearing configured to substantially prevent tilt of said axis of said hinge structure.

5. The door assembly of claim 1, wherein said slide mechanism includes a tilt preventing mechanism including:

(a) an upper toothed track associated with said upper edge of said surround;

(b) a lower toothed track associated with said lower edge of said surround; and (c) a gear wheel assembly associated with said intermediate element, said gear wheel assembly including:

(i) an upper gear wheel engaged with said upper toothed track; and (ii) a lower gear wheel engaged with said lower toothed track, said lower gear wheel being mechanically coupled so as to rotate with said upper gear wheel.

6. The door assembly of claim 5, wherein said intermediate element includes a rigid rod interconnecting between said upper and lower gear wheels.

7. The door assembly of claim 5, wherein said gear wheel assembly includes a flexible drive shaft mechanically linked to said upper and lower gear wheels so as to couple them for rotation.

8. The door assembly of claim 5, wherein said gear wheel assembly includes a jointed mechanical linkage mechanically linked to said upper and lower gear wheels so as to couple them for rotation.

9. The door assembly of claim 1, wherein said surround has a left side and a right side, and wherein said intermediate element extends from said upper edge to said lower edge, said the slide mechanism including:

(a) a linear bearing track associated with said intermediate element and of said upper edge and said lower edge of said surround; and (b) a tilt preventing mechanism including:

(i) a plurality of guide elements associated with said intermediate element and configured to define first and second cable courses running from substantially adjacent to said upper edge to substantially adjacent to said lower edge, (ii) a first cable extending from adjacent to said the left side of said upper edge across a first portion of said upper edge, down said first cable course to adjacent to said lower edge, and across a second portion of said lower edge to adjacent to the right side of said lower edge, and (iii) a second cable extending from adjacent to the right side of said upper edge across a second portion of said upper edge, down said second cable course to adjacent to said lower edge, and across a first portion of said lower edge to adjacent to the left side of said lower edge.

10. The door assembly of claim 1, wherein said surround has an upper edge, a lower edge, a left side and a right side, and wherein said intermediate element extends substantially from said upper edge to said lower edge, said slide mechanism including:

(a) a linear bearing track associated with said intermediate element and at least one of said upper edge and said lower edge of said surround; and (b) a tilt preventing mechanism including:

(i) a first closed belt attached to an upper portion of said intermediate element and extending across said surround adjacent to said upper edge from adjacent to said left side to adjacent to said right side.

(ii) a second closed belt attached to a lower portion of said intermediate element and extending across said surround adjacent to said lower edge from adjacent to said left side to adjacent to said right side, and (iii) a mechanical belt linkage associated with both said first and said second belts and configured to maintain movements of said first and said second belts in-step.

11. The door assembly of claim 1, wherein said surround has a first side and a second side, and wherein said intermediate element extends from said upper edge to said lower edge, said slide mechanism including:

(a) a linear bearing track associated with said intermediate element and at least one of said upper edge and said lower edge of said surround; and (b) a tilt preventing mechanism including:

(i) a plurality of guide elements defining a cable course extending around said surround from said first side across said upper edge to adjacent to said second side, back across said upper edge to said first side, down to adjacent to said lower edge, across said lower edge from said first side to adjacent to said second side and back to said first side, and back to said upper edge, and (ii) a closed cable deployed along said cable course, wherein said intermediate element is attached to said closed cable at a first attachment position adjacent to said upper edge and a second attachment position adjacent to said lower edge such that said first and second attachment positions move across said upper and lower edges in-step.

12. A hinged and sliding door assembly for a vehicle comprising:

(a) a door surround defining an opening;

(b) a door configured for mating with said door surround; and (c) a hinge-and-slide mechanism for supporting, and defining movement of, said door relative to said door surround, said hinge-and-slide mechanism including:

(i) a hinge structure connected to said door surround, (ii) a slide mechanism associated with said door surround and configured to define a slide path relative to said door surround, and (iii) a mode-switching mechanism associated with said door and with both said hinge structure and said slide mechanism, said mode-switching mechanism including at least one displaceable engagement member, said mode-switching mechanism being deployable between a first state in which said mode-switching mechanism defines a hinged engagement between said door and said hinge structure to allow swung opening of said door and a second state in which said mode-switching mechanism disengages said hinged engagement and supports said door by attachment to said slide mechanism such that said door is slidable to an open position substantially displaced from said opening.

* * * * *